US007475955B2

(12) United States Patent
Dressendorfer et al.

(10) Patent No.: US 7,475,955 B2
(45) Date of Patent: Jan. 13, 2009

(54) STORAGE ASSEMBLY FOR MODULES OF VARYING SIZES AND IMPROVED SHELVING THEREFOR

(76) Inventors: Michael R. Dressendorfer, 352 Rebecca Dr., San Dimas, CA (US) 91733; Bernard A. Higuera, 14359 Spring Dr., Chino Hills, CA (US) 91709

( * ) Notice: Subject to any disclaimer, the term of this patent is extended or adjusted under 35 U.S.C. 154(b) by 244 days.

(21) Appl. No.: 09/823,204

(22) Filed: Apr. 2, 2001

(65) Prior Publication Data

US 2002/0140328 A1 Oct. 3, 2002

(51) Int. Cl.
*A47B 88/12* (2006.01)

(52) U.S. Cl. ..... 312/334.26; 312/334.23; 312/198

(58) Field of Classification Search ..... 312/304, 312/334.23, 334.26, 321, 198, 199, 201, 312/330.1, 334.25, 334.27, 334.44, 334.24; 211/162; 104/94, 107, 109
See application file for complete search history.

(56) References Cited

U.S. PATENT DOCUMENTS

| | | | | | |
|---|---|---|---|---|---|
| 660,999 | A | * | 10/1900 | Richard | |
| 1,722,731 | A | * | 7/1929 | Burstein | 16/88 |
| 1,802,102 | A | * | 4/1931 | Ziegler et al. | 312/304 |
| 4,524,698 | A | * | 6/1985 | Tourtellier et al. | 104/107 |
| 4,657,317 | A | * | 4/1987 | Gemma | 211/162 |

* cited by examiner

*Primary Examiner*—James O Hansen
(74) *Attorney, Agent, or Firm*—Kenneth L. Green; Edgar W. Averill, Jr.

(57) ABSTRACT

A storage cabinet (30, 216) has a number of drawers (38) with shelves (52) having cutout walls (78, 80) providing side support for stored modules (46). An alternative shelving unit (84) includes a spring member (96) with leaf springs (98) that press stored modules (46) against a lip (90) on the unit. The drawers (38) have roller apparatus (190,192) on a topmost surface which hangingly roll within curved holders (212, 214).

3 Claims, 6 Drawing Sheets

STORAGE ASSEMBLY FOR MODULES OF VARYING SIZES AND IMPROVED SHELVING THEREFOR

BACKGROUND

1. Field of the Invention

The present invention relates generally to a storage assembly which can be advantageously employed to quantity store information media modules, and to improved shelving for use in such an assembly which enables accommodating simultaneously media modules of considerable size variation.

2. Description of Related Art

Present-day information storage is being accomplished in ever increasing quantities and in a variety of media cartridges of different dimensions. It is, of course, a given that the density of storage achieved by any storage system should be as high as possible while at the same time provide ease of access to individual information storage items.

A well received modular compact storage assembly is that set forth in U.S. Pat. No. 4,657,317, STORAGE ASSEMBLY, which includes storage cabinets containing a number of storage panels or drawers on which a plurality of media articles or modules may be supported. More particularly, the storage panels may be slidingly moved from a stored to a withdrawn position with respect to the cabinets, and when in the withdrawn mode enable access to store new media modules or remove previously stored modules.

Although the patented storage assembly provides satisfactory information media storage, improvement is desirable in overall storage cabinet construction, the mechanism for enabling sliding movement accorded the storage panels or drawers, as well as providing the ability to accommodate a wider range of different sized articles being stacked together on given shelving with the ultimate aim of achieving concomitant information storage density increase.

SUMMARY OF THE INVENTION

It is, therefore, a primary feature of the invention to provide an improved upright storage cabinet with one or more storage drawers that can be slidingly stored within the cabinet or extended exteriorly of the cabinet to provide access to storage articles located on drawer shelving.

In accordance with a further feature, the individual storage panels are related to the cabinet by paired roller assemblies having built-in stops preventing extension of the panels from the cabinet beyond a predetermined safe limit.

In accordance with a primary assembly aspect of the invention, a drawer storage cabinet is formed by welding strut members to one another defining a frame about internal containing space with sheetlike panels being removably mounted onto the struts to enclose the cabinet sides. Individual drawers of the storage assembly cabinet include improved guide means received about rollers mounted to the cabinet providing efficient and reliable transport of the drawers from stored to access modes of use.

In a first shelving embodiment, a generally L-shaped shelf base and backplate member has end portions received into accommodating slots on each of two sidewall shelving members. Article guides are formed in the base and backplate member by cutting and forming a plurality of projections for guidingly positioning media articles in a side-by-side, spaced apart relation.

In a second shelving embodiment, leaf springs affixed to a shelving base serve to retain media articles on the shelving during storage mode and aid in releasing the articles during removal from the shelving.

BRIEF DESCRIPTION OF THE DRAWING FIGURES

DETAILED DESCRIPTION OF EMBODIMENTS OF THE INVENTION

Figure 1:
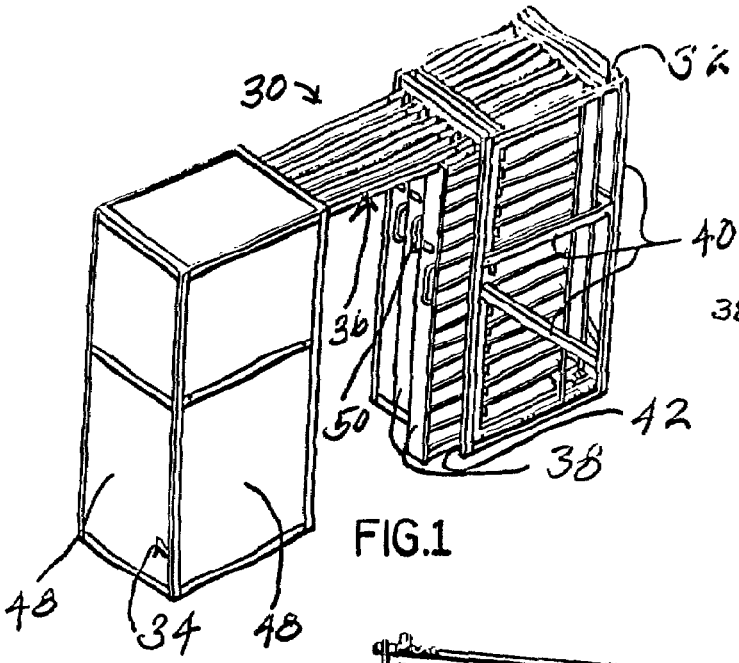
FIG. 1 is a perspective view of a first version of a multiple panel or drawer storage cabinet assembly.
Figure 2:
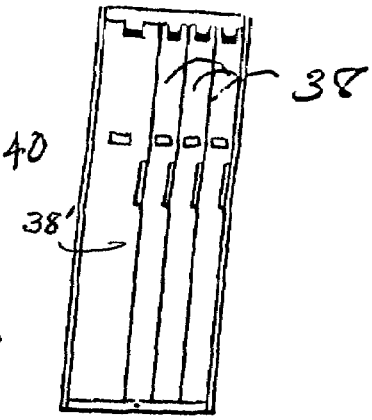
FIGS. 2 and 3 show frontal views looking into the shelving and viewed into pull-handle drawer surfaces, respectively.
Figure 3:
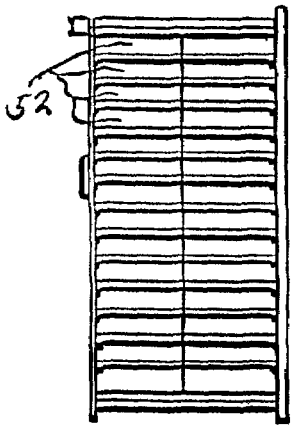

With reference now to the drawing and particularly FIGS. 1-3, there is shown a multiple drawer storage cabinet assembly 30 with which the invention to be described in its various embodiments can be advantageously employed. As shown, the assembly 30 includes first and second floor-based frame compartments 32 and 34 held in fixed spaced apart relation by a plurality of overhead tracks 36. Each compartment can receive and store a plurality of vertically extending drawers 38, which drawers are arranged to enable movement along the tracks 36 out of the compartments via roller assemblies to be described providing access to media articles supported on panel shelves. The previously referenced patent U.S. Pat. No. 4,657,317 provides detailed description of a storage assembly of this general kind.

Each compartment 32, 34 is constructed of a plurality of metal struts 40 with their ends welded or mechanically secured together to form a frame containing space within which drawers 38 are stored. An access opening 42 is provided via which drawers 38 can be extended to store and remove modules 46. The remaining three compartment sidewalls are preferably enclosed by square or rectangular cover plates 48. For convenience of understanding, the compartment 32 is shown without cover plates 48 and the compartment 34 is depicted with cover plates assembled thereon. In a finished cabinet assembly both compartments will be provided with cover plates.

In use and referring to FIGS. 1-3, each compartment receives a plurality of drawers 38 stored in side-by-side relation and by means of individual handles 50 the individual drawers can be pulled out of a storage compartment to provide access to horizontal storage shelves 52 which are arranged one above the other in each drawer.

The drawers may be of different widths in the same drawer to accommodate different sized modules 46 as indicated at 38' in FIG. 2 (e.g., 4",5"-18").

The described compartment construction provides a more reliably rigid assembly than that set forth in the referenced patent art for maintaining design configuration integrity during various loading conditions and thereby insuring against the possibility of locking or jamming produced by inadvertent contact of adjacent drawers and tracks during use.

Figure 4:
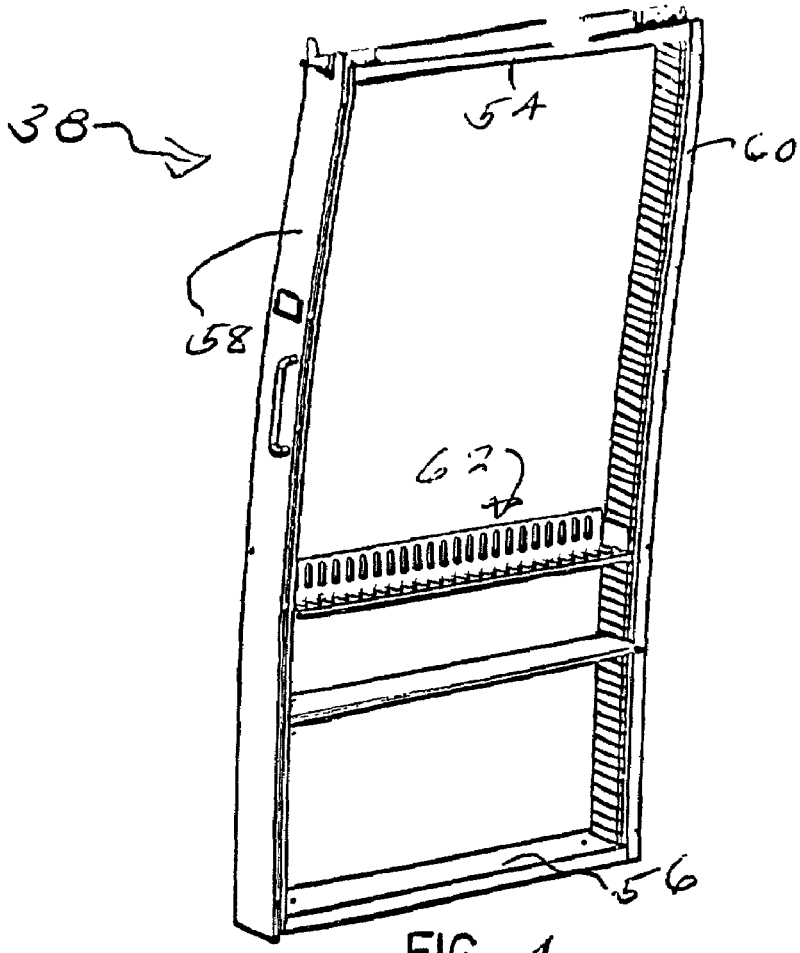
FIG. 4 is a perspective view of a drawer showing shelving according to a first embodiment.

As can be seen best in FIG. 4, each drawer 38 includes an outer support frame consisting of top and bottom members 54 and 56, respectively, and two side members 58 and 60, all end connected into a unitary generally parallelepiped configuration. A handle 50 is affixed to what is the outwardly facing surface of the drawer at a convenient height for use. This drawer construction can be utilized for all of the different shelving embodiments to be described.

Figure 5:
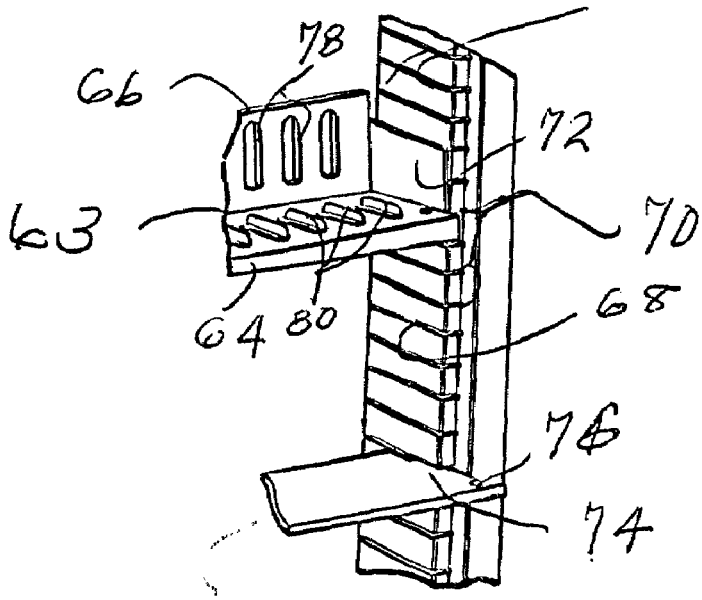
FIG. 5 is an enlarged view of shelving details of the FIG. 4 embodiment.

Turning now to FIGS. 4 and 5, a first embodiment of shelving enumerated as 62 includes a generally L-shaped metal body member 63 with a base plate 64 and backplate 66. The inwardly facing surface of both side members is provided with a plurality of parallel, uniformly spaced apart slots 68 (only shown on 60). The slots terminate at their bottom in a slightly enlarged opening 70. An endplate 72 secured to each end of the body member 61 includes a key 74 with a slightly downwardly directed hook 76. A shelving 62 is mounted within a drawer 38 by inserting the shelving key 74 into a slot 68 with the hook 76 being positioned within the enlarged opening 70 of the slot.

The backplate 66 has a plurality of cutout shallow walls 78 formed in uniformly spaced apart relation across the entire length of the backplate, the spacing between adjacent walls 78 being such as to comfortably accommodate the width of one module 46 inserted edgewise therebetween (FIG. 5). Similarly, a plurality of cutout shallow walls 80 are formed in the baseplate 64 vertically aligned with the walls 78 and in a one for one arrangement. Also, the keys 74 for each shelving member are canted so as to cause the base plate and backplate to be tilted backwardly a slight amount thereby holding a module more reliably against falling off the shelving (FIG. 9).

Figure 9:
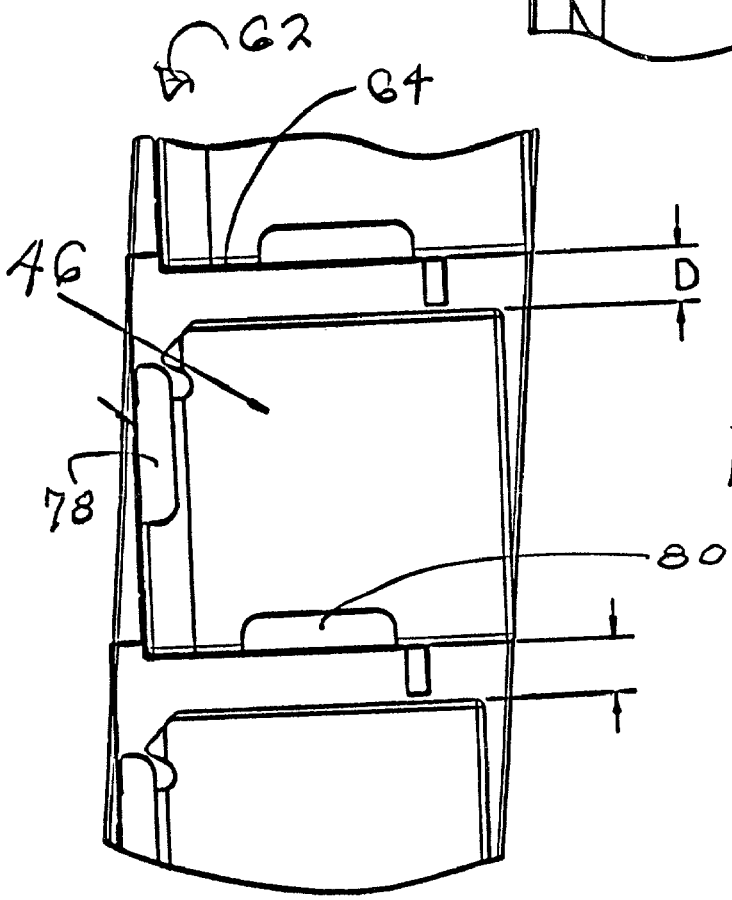

FIG. 9 shows a module 46 mounted onto shelving 62 and as seen looking along the shelf. It is to be noted that the vertical distance D from the top of one stored module to the bottom of the next above baseplate 64 is sufficient to receive one or more fingers of the hand to aid in retrieving a stored module 46 from a shelf.

Figure 6:
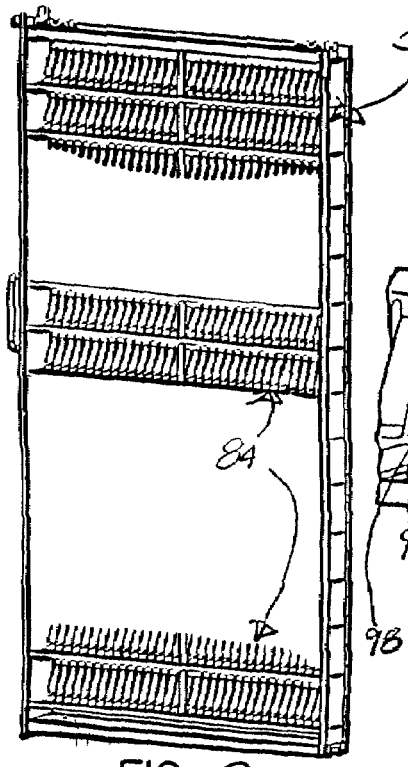
FIGS. 6 and 7 show a second embodiment of drawer shelving.
Figure 7:
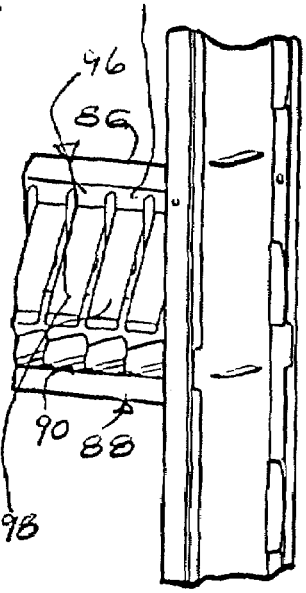
Figure 8:
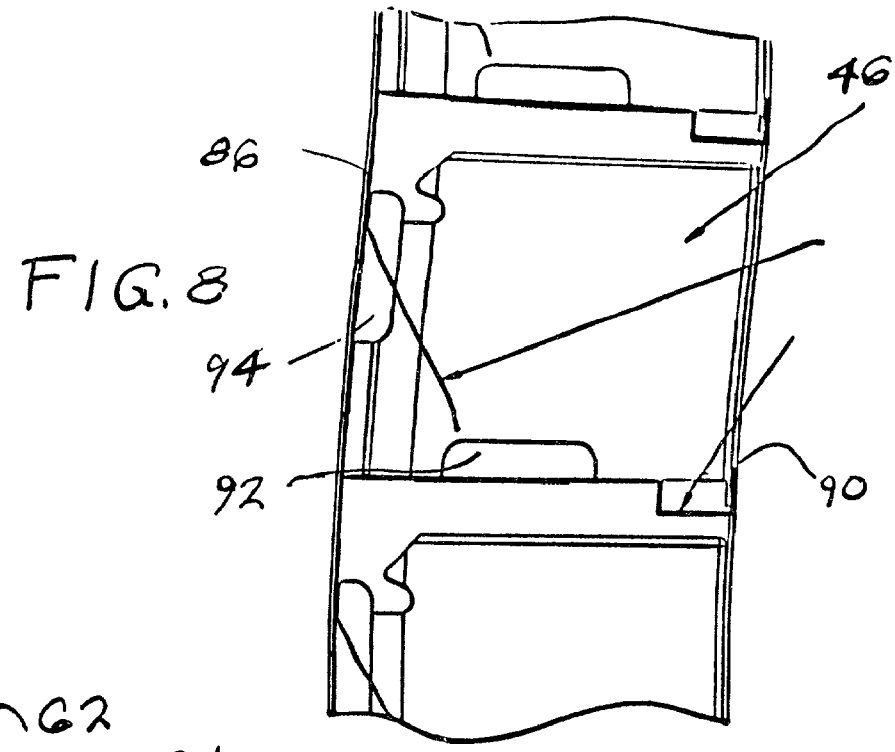
FIGS. 8 and 9 are elevational views showing modules stored on the first and second shelving embodiments.

For the ensuing description of a second embodiment of shelving, reference is made particularly to FIGS. 6, 7 and 8. As before, a plurality of shelving units 84 are provided in parallel, vertically spaced apart relation within a drawer 38. Each shelving unit includes a one-piece, generally L-shaped member consisting of a backplate 86 and a baseplate 88, the front or lower edge portion of which is formed upwardly into a lip 90. A plurality of cutout guide projections 92 from the baseplate are arranged in uniformly spaced apart relation and extending upwardly and normally to both the backplate 86 and the lip 90. The spacing between adjacent guide projections 92 is such as to enable receipt of a module 46 inserted edgewise therebetween. (FIG. 8). A set of cutout guide projections 94 are similarly formed in the backplate 86 aligned, respectively, with projections 92.

A spring member 96 unitarily includes a number of individual leaf springs 98 which extend in a common direction from a base 100. On assembly, the base is secured to the backplate and the leaf springs 98 are so dimensioned as to individually extend downwardly between adjacent guide projections 94 and forwardly toward the lip 90 (FIG. 8). Although other materials may be found satisfactory, excellent results have been obtained with spring members 96 constructed of stainless steel.

To store a module 46 in a shelving unit 84 of the second embodiment, the module is inserted edgewise between an adjacent pair of cutout projections 92 on the backplate as well as between an aligned pair of projections 94 on the baseplate. The module is pushed against the leaf spring 98 in that slot compressing it following which the module edge facing outwardly is forced downwardly a slight amount to trap the module edge behind the lip 90. To remove a stored module, finger pressure is applied to the outwardly facing edge of the desired module both compressing the leaf spring and moving the module front edge up and out of contact with the lip 90. The module is now free to be withdrawn from storage.

Figure 10:
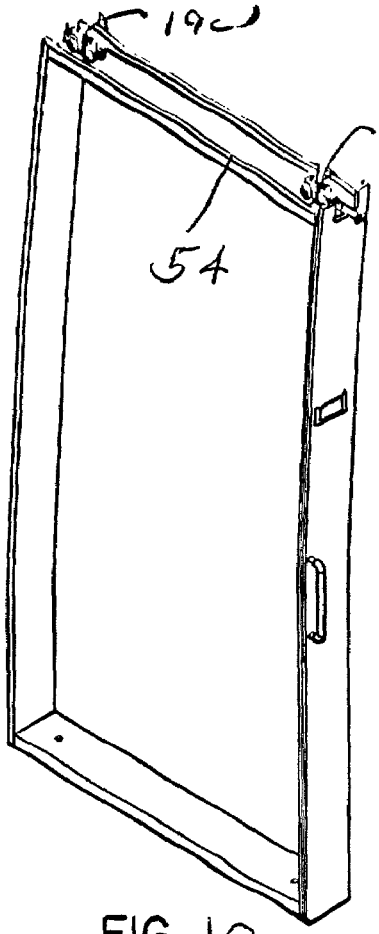
FIG. 10 depicts in perspective view a hanging roller arrangement mounted onto a drawer.
Figure 11:
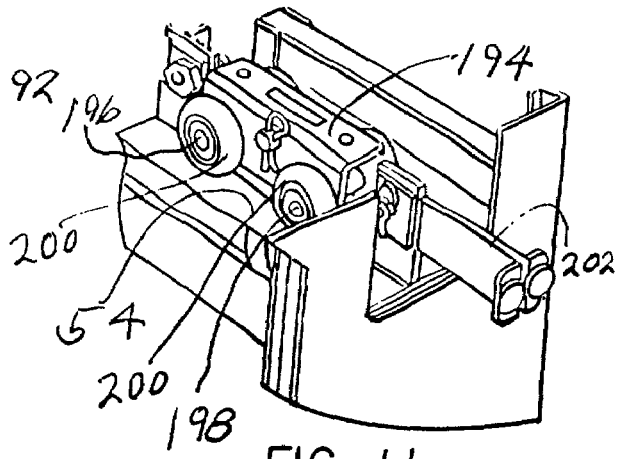
FIGS. 11-13 are enlarged perspective and elevational views of roller arrangement.
Figure 12:
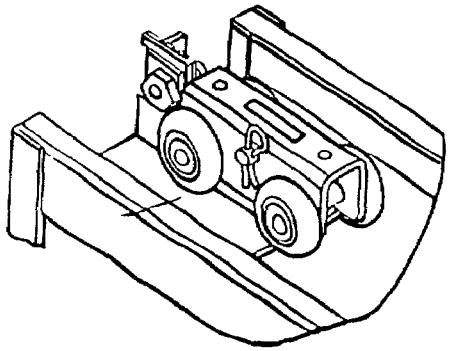

As can be seen best in FIG. 10, each drawer 38 has first and second roller apparatus 190 and 192, respectively, secured to the topmost surface of the drawer frame member 54. Each roller apparatus includes a stanchion 194 secured along a longitudinal axis of a drawer top member 54. A pair of axles 196 and 198 extend transversely through suitable openings in the stanchion normally to the longitudinal axis and spaced apart from one another. A pair of rollers 200 are mounted to each axle, one at each side of the stanchion. Also, the rollers are preferably identical to one another, and those rollers on the same side of the stanchion are aligned with one another and parallel to the longitudinal axis.

The stanchion for roller apparatus 192 which is adjacent the drawer panel containing a drawer handle 50 includes a limit stop arm 202 that extends outwardly beyond the handle containing side panel. The purpose of the stop arm is to prevent facing drawers 38 in the FIG. 1 version from having their respective handles 50 hit one another and possibly injure a user's fingers or hands. Specifically, the limit stop arms 202 of the facing drawers can strike one another thereby holding the two drawers at a predetermined safe spacing.

Figure 13:
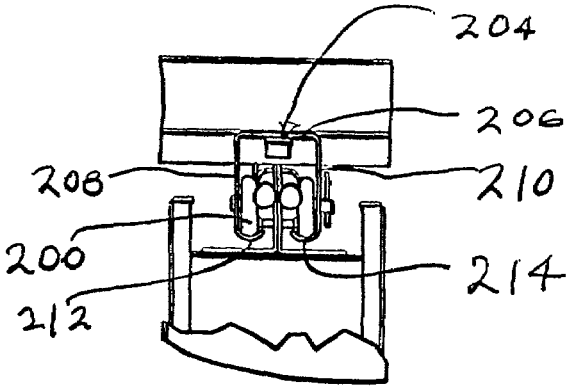

Turning now to FIG. 13, the details of the track 36 construction for the roller apparatus 190 and 192 will now be described. In section, the track is seen to include an elongated, generally U-shaped banging guide 204 with a crossbar 206 secured to the track and the two arms 208 and 210 extending downwardly with their lower edge portions being formed toward each other providing curved holders 212 and 214 for rollers 200 on opposite sides of an axle. This construction has been found to be more efficient and reliable than other known roller suspension systems.

Figure 14:
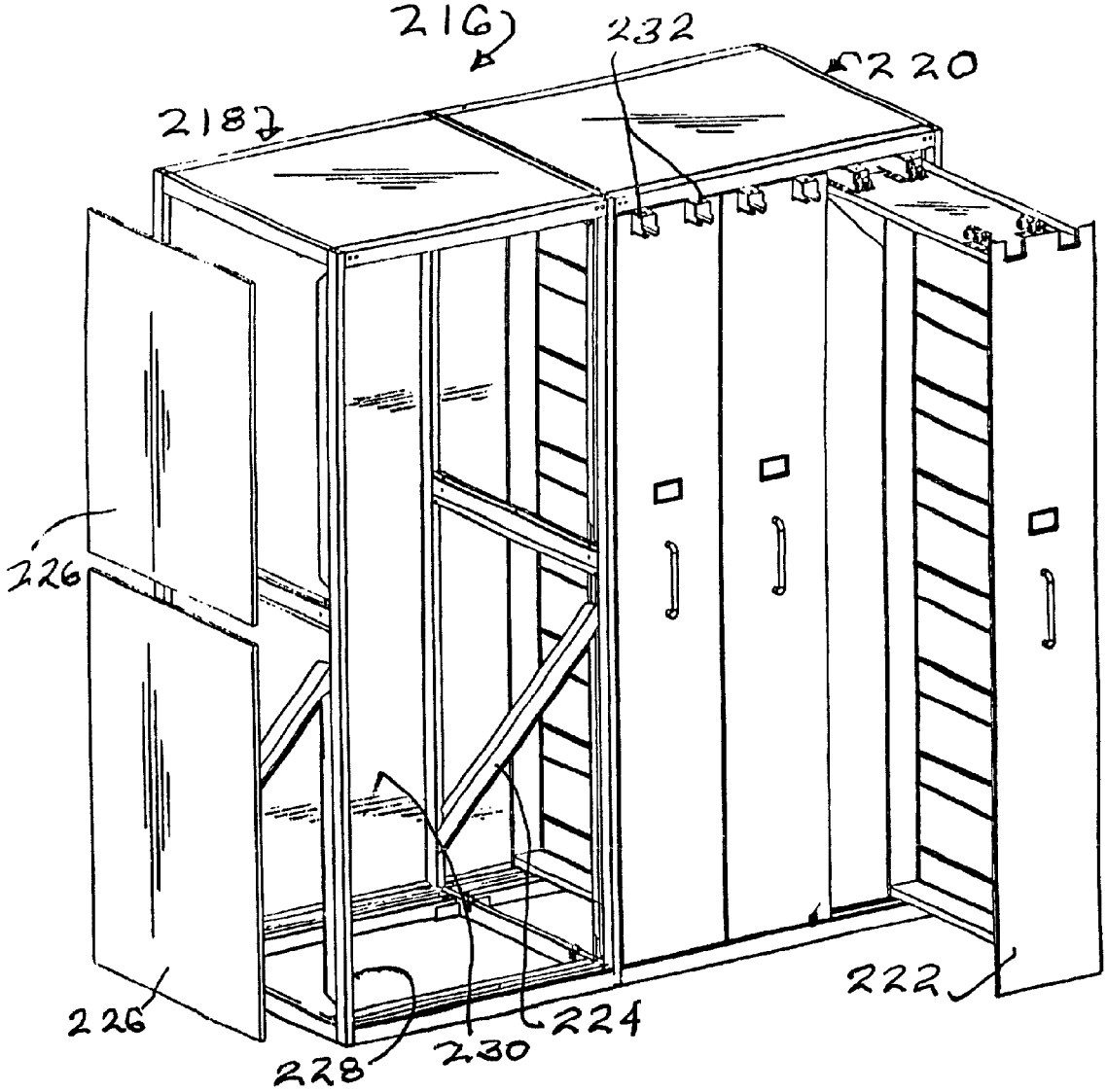
FIG. 14 is a perspective of an alternative version of a multiple panel cabinet assembly for use with the present invention.
Figure 15:
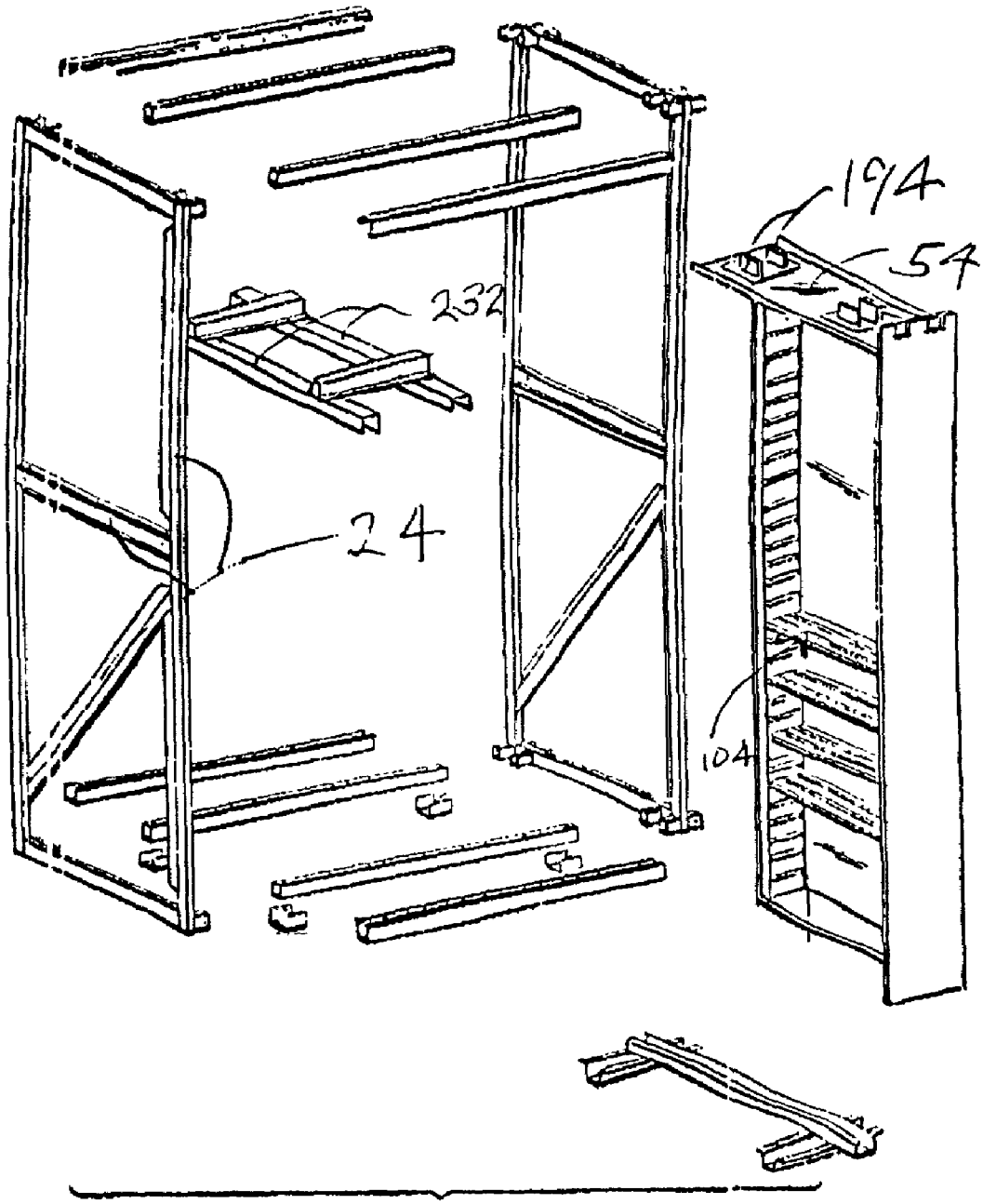
FIG. 15 is an exploded view of the cabinet of FIG. 22.

FIGS. 14 and 15 show an alternative version of a drawer cabinet assembly 216 which provides an increase of module storage density over the first described version by removing the requirement for a non-storage space between two compartments 32 and 34 of the first version which may be advantageous under certain restricted space availability situations. As shown, there are two drawer compartments 218 and 220 in side by side relation, one depicted with drawers 222 and the other empty to display constructional features. The compartments are of frame construction with struts 224 welded together and enclosed by metal panels 226 as in compartments 32 and 34 with an open access front 228 and a closed rear surface 230 as well as closed top and two side walls. The drawers 222 can be identical to the drawers 38 including the roller apparatus which can be identical to roller apparatus 190 and 192 excluding the limit stop arms 202 which are not required in this version. Guide tracks 232, which can be identical to the previously described hanging guide 204, are located within each compartment 218 and 220 and are affixed to struts 224 defining the frame top for the compartment.

Specifically, the guide tracks 232 extend from the compartment rear to the front providing roller assisted movement of the drawers 222 from storage to access modes, as described earlier. The drawers can include any of the shelving embodiments previously described herein.

Although the invention has been described in connection with preferred embodiments, it is to be understood that those skilled in the appertaining arts may make modifications that come within the spirit of invention as described and within the ambit of the appended claims.

What is claimed is:

1. In a multiple drawer storage cabinet assembly having overhead tracks from which drawers are suspended and along which the drawers can be moved from storage within the cabinet to a location externally of the cabinet enabling access to the drawers, the improvement comprising:

each drawer including an outer support frame with a top member and a front side member and a back side member;

first and second roller apparatus secured to the top member in spaced apart aligned relation for receipt within a hanging guide, each roller apparatus having a stanchion, a pair of axles mounted to the stanchion, and a pair of rollers mounted on each axle such that the two axles are arranged parallel to each other, the two rollers, one of each pair, are located on one side of the stanchion and in the same rotational plane, each said roller having a continuously curved convexly extending peripheral edge with the first roller apparatus being secured adjacent said front side member;

a generally U-shaped hanging guide with two arms spaced apart sufficiently to receive the pairs of mounted rollers therebetween, lower edge portions of the spaced apart arms are formed facing each other to provide curved holders along which the pairs of rollers can move and hang therefrom; and a stop arm secured to the stanchion of said first roller apparatus outwardly along the path of drawer movement away from the rollers and extending outwardly with respect to and beyond said front side member.

2. A storage cabinet assembly as in claim 1, in which the storage cabinet is constructed of a plurality of strut means having respective end portions welded to one another to form a framework drawer containing space; and a plurality of plates secured to the outer surface of the framework enclosing the containing space.

3. A storage cabinet assembly as in claim 1, in which the storage cabinet is constructed of a plurality of strut means having respective end portions mechanically secured to one another to form a framework drawer containing space; and a plurality of plates mechanically secured to the outer surface of the framework enclosing the containing space.

* * * * *